US010589904B2

(12) United States Patent
Farstad et al.

(10) Patent No.: US 10,589,904 B2
(45) Date of Patent: Mar. 17, 2020

(54) FLEXIBLE PACKAGING WITH A STRAINING FEATURE

(71) Applicant: Dow Global Technologies LLC, Midland, MI (US)

(72) Inventors: Andre Farstad, Savannah, GA (US); Maria Isabel Arroyo Villan, Tarragona (ES); Marcelo Tognola, Tarragona (ES)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 16/064,849

(22) PCT Filed: Dec. 15, 2016

(86) PCT No.: PCT/US2016/066819

§ 371 (c)(1),
(2) Date: Jun. 21, 2018

(87) PCT Pub. No.: WO2017/112511

PCT Pub. Date: Jun. 29, 2017

(65) Prior Publication Data

US 2019/0009950 A1 Jan. 10, 2019

(30) Foreign Application Priority Data

Dec. 21, 2015 (EP) ..... 15382652

(51) Int. Cl.
*B65D 33/01* (2006.01)
*B65D 75/58* (2006.01)
(Continued)

(52) U.S. Cl.
CPC ..... *B65D 33/01* (2013.01); *B65D 75/5805* (2013.01); *B65D 81/22* (2013.01); *B65D 81/261* (2013.01); *B65D 75/008* (2013.01)

(58) Field of Classification Search
CPC .... B65D 33/01; B65D 75/5805; B65D 81/22; B65D 81/261; B65D 75/008
(Continued)

(56) References Cited

U.S. PATENT DOCUMENTS 4,486,187 A * 12/1984 Foster ..... B65D 75/5894 493/194
4,576,316 A * 3/1986 Foster ..... B65D 75/5894 206/484

(Continued)

FOREIGN PATENT DOCUMENTS

CA 2366418 A1 * 10/2000 ..... B65D 75/5855
EP 471211 A1 7/1991

(Continued)

OTHER PUBLICATIONS

Office Action pertaining to corresponding Chinese Patent Application No. 201680074689.X, dated Apr. 8, 2019.

(Continued)

*Primary Examiner* — Jes F Pascua
(74) *Attorney, Agent, or Firm* — Dinsmore & Shohl LLP

(57) ABSTRACT

Embodiments of a flexible pouch (1) comprise a pouch body (10), a collapsible perforated folded panel (50), an opening seal (60) disposed between the collapsible perforated folded panel (50) and the second ends (18, 19) of a front wall (12) and a rear wall (14), wherein the opening seal (60) adheres the second end (18) of the front wall (12) to the second end (19) of the rear wall (14) which thereby conceals the collapsible perforated folded panel (50). The release or removal of the opening seal (60) is operable to expose the collapsible perforated folded panel (50) and application of a pull force is operable to outwardly expand the collapsible
(Continued)

perforated folded panel (50) to allow draining of liquid or dispensing of dry powder or flakes from the pouch chamber (52).

20 Claims, 4 Drawing Sheets

(51) Int. Cl.
*B65D 81/22* (2006.01)
*B65D 81/26* (2006.01)
*B65D 75/00* (2006.01)

(58) Field of Classification Search
USPC ..... 383/67, 906, 210–211
See application file for complete search history.

(56) References Cited

U.S. PATENT DOCUMENTS

| | | | | |
|---|---|---|---|---|
| 4,960,216 | A | 10/1990 | Giles et al. | |
| 5,246,106 | A | 9/1993 | Johnson | |
| 5,513,781 | A | 5/1996 | Ullrich et al. | |
| 5,709,479 | A | 1/1998 | Bell | |
| 5,776,284 | A | 7/1998 | Sykes et al. | |
| 5,785,428 | A | 7/1998 | Mazzocchi | |
| 5,914,142 | A | 6/1999 | Zartner | |
| 5,971,613 | A | 10/1999 | Bell | |
| 6,333,060 | B1 * | 12/2001 | DiDonato | B65D 81/22 426/112 |
| 6,375,037 | B1 * | 4/2002 | Bell | B65D 75/008 206/439 |
| 7,863,383 | B2 | 1/2011 | Gibbons et al. | |
| 8,944,684 | B2 * | 2/2015 | Bell | B65D 31/10 383/10 |
| 2008/0240626 | A1 * | 10/2008 | Bell | B65D 31/10 383/120 |
| 2014/0370160 | A1 | 12/2014 | Martin et al. | |
| 2015/0158643 | A1 | 6/2015 | Coker et al. | |
| 2017/0313494 | A1 * | 11/2017 | Gundersen | B65D 83/0055 |

FOREIGN PATENT DOCUMENTS

| | | | |
|---|---|---|---|
| EP | 0790193 | A1 | 8/1997 |
| EP | 1659074 | A1 | 5/2006 |
| FR | 2878143 | A1 | 5/2006 |
| JP | S57180678 | A | 11/1982 |
| JP | 2007028406 | A | 2/2007 |
| JP | 2010280422 | A | 12/2010 |
| JP | 2011011807 | A | 1/2011 |
| WO | 2007096930 | A1 | 8/2007 |
| WO | 2013143706 | A1 | 10/2013 |
| WO | 2014181129 | A1 | 11/2014 |

OTHER PUBLICATIONS

European Extended Search Report pertaining to European Application No. 15382653.1 dated Jun. 1, 2016.
European Extended Search Report pertaining to European Application No. 15382652.4 dated Apr. 28, 2016.
International Search Report and Written Opinion pertaining to PCT/US2016/066838 dated Feb. 27, 2017.
International Search Report and Written Opinion pertaining to PCT/US2016/066819 dated Feb. 3, 2017.

* cited by examiner

FLEXIBLE PACKAGING WITH A STRAINING FEATURE

CROSS-REFERENCE TO RELATED APPLICATION

This application claims priority to European Patent Application No. 15382652.4 filed Dec. 21, 2015, which is incorporated by reference herein in its entirety.

TECHNICAL FIELD

Embodiments of the present disclosure generally relate to flexible product packaging. More specifically, embodiments of the present disclosure relate to flexible packages comprising a straining feature for products stored and transported in a preserving liquid or for dispensing a dry powdered or flaked product.

BACKGROUND

A variety of foodstuffs and other consumer goods are packaged for storage or transport in a fluid. For example, fresh mozzarella cheese and pickles are commonly packaged in a liquid to maintain their quality and characteristics between manufacture and consumption by the consumer. Additionally, ball bearings or other machined parts may be packaged and transported in a preserving fluid, such as oil or alcohol, to prevent oxidation or other detrimental changes before use and/or installation. A vast array of other fields utilize products which are similarly stored, transported, or packaged in a fluid which needs to be drained before utilization of the product.

The difficulty for the consumer with packaging where a solid product is contained in a liquid is that it can be difficult for the consumer to access the product without risking an accidental spill of the liquid, and/or the solid product. Conventional containers for packaging a solid product in a liquid may not attempt to provide a means for separation of the liquid and solid product. For example, a glass jar of pickles with a standard twist off cap necessitates reaching into the pickling solution with a finger or fork to retrieve a pickle. Other solutions which have attempted to solve this problem include utilization of a second removable container with draining capabilities nested within a main outer container. However, such dual container arrangements present a more costly and complicated manufacturing process.

Accordingly, there remains a need for a flexible package that facilitates consumer access to a solid product stored in a liquid while minimizing the risk of an accidental spill of the liquid and/or solid product.

SUMMARY

Embodiments of the present disclosure are directed to flexible packages with a straining feature to allow drainage of a liquid from a flexible package, such as a stand-up pouch or a pillow pouch, while retaining solids therein. Embodiments of the present disclosure are also directed to flexible packages with a straining feature to allow dry powder or flaked products to be dispensed from a flexible package, such as a stand-up pouch or a pillow pouch.

In accordance with one embodiment, a pouch is provided. The pouch comprises a pouch body formed from a first flexible film. The pouch body includes a front wall and a rear wall, the front wall and the rear wall each having a first end, a second end, and side edges connecting the first end and the second end. The rear wall is adhered to the front wall at corresponding first ends to form a first end seal and corresponding side edges to form side seals. The pouch also comprises a collapsible perforated folded panel formed from a second flexible film. The collapsible perforated folded panel is attached to the front wall and the rear wall at interior portions of the front wall and rear wall, respectively. The attachment of the collapsible perforated folded panel to the front wall and the rear wall defines a pouch chamber. The pouch includes an opening seal disposed between the collapsible perforated folded panel and the second ends of the front wall and the rear wall. The opening seal adheres the second end of the front wall to the second end of the rear wall which thereby conceals the collapsible perforated folded panel. Release or removal of the opening seal is operable to expose the collapsible perforated folded panel by separating the front wall from the rear wall along the second ends. Application of a pull force to the second end of the front wall and to the second end of the rear wall is operable to outwardly expand the collapsible perforated folded panel to allow draining of liquid from the pouch chamber.

These and additional features provided by the embodiments of the present disclosure will be more fully understood in view of the following detailed description, in conjunction with the drawings.

BRIEF DESCRIPTION OF THE DRAWINGS

The following detailed description of specific embodiments of the present disclosure can be best understood when read in conjunction with the drawings enclosed herewith.

Figure 1:
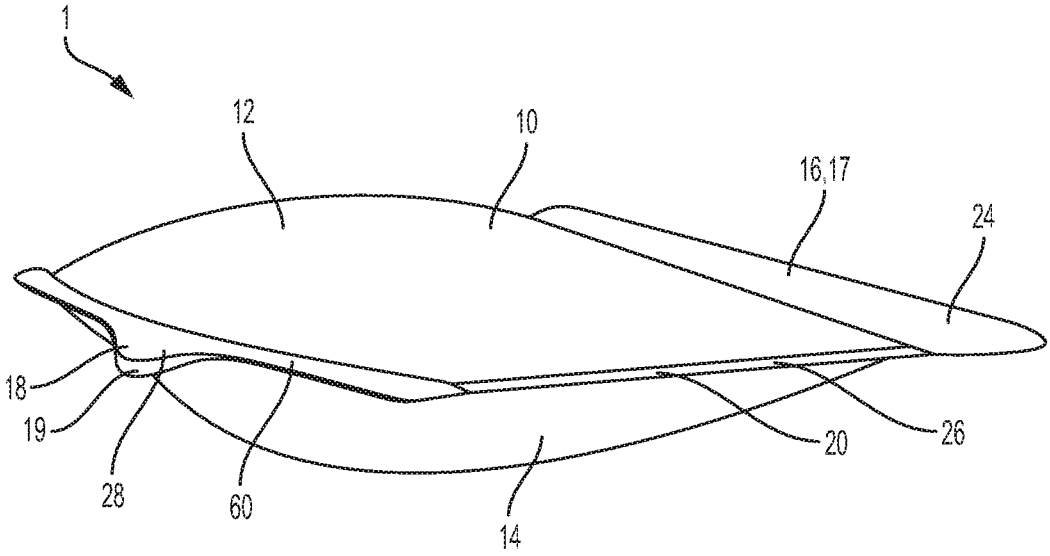
FIG. 1 is a schematic view of a pouch according to one or more embodiments of the present disclosure.

The embodiments set forth in the drawings are illustrative in nature and not intended to be limiting to the claims. Moreover, individual features of the drawings will be more fully apparent and understood in view of the detailed description.

DETAILED DESCRIPTION

Figure 2:
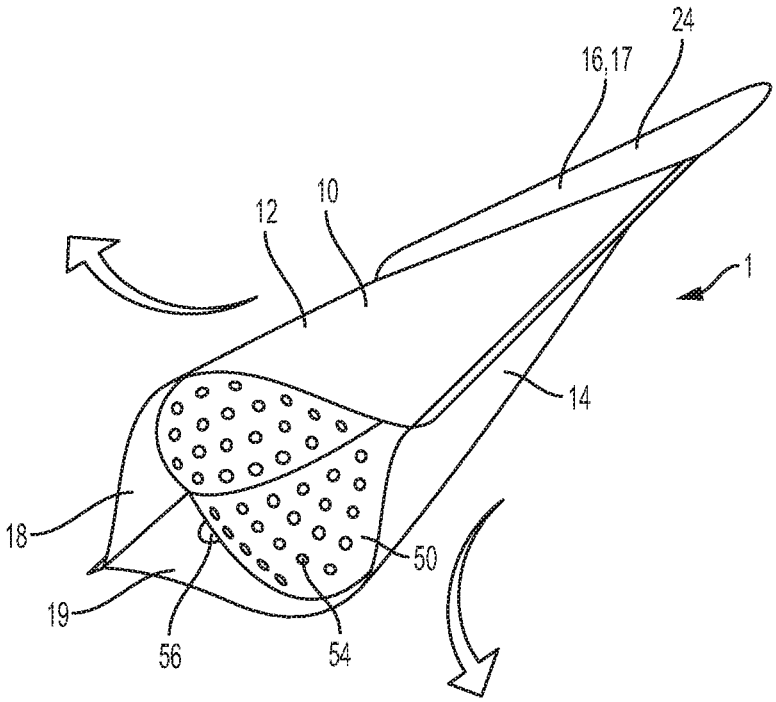
FIG. 2 is a schematic view of a pouch with the opening seal opened according to one or more embodiments of the present disclosure.

Referring to FIGS. 1 and 2, one or more embodiments of a pouch 1 are shown. The depicted pouches 1 are rectangular; however, various additional sizes and shapes are contemplated herein and within the scope of this disclosure. As stated above, the pouch 1 could be a pillow pouch or a stand-up pouch. The pouch 1 includes a pouch body 10 formed from a front wall 12 and a rear wall 14. The front wall 12 has a first end 16 and a second end 18 and the rear wall 14 has a first end 17 and a second end 19. Further, side edges 20 connect the first ends 16, 17 and the second end 18, 19. The rear wall 14 is adhered to the front wall 12 at corresponding first ends 16, 17 to form a first end seal 24. Additionally, the rear wall 14 is adhered to the front wall 12 at corresponding side edges 20 to form side seals 26. The pouch body 10 is formed from a first flexible film 30. In one or more embodiments, the front wall 12 and the rear wall 14 are different compositions.

Figure 3:
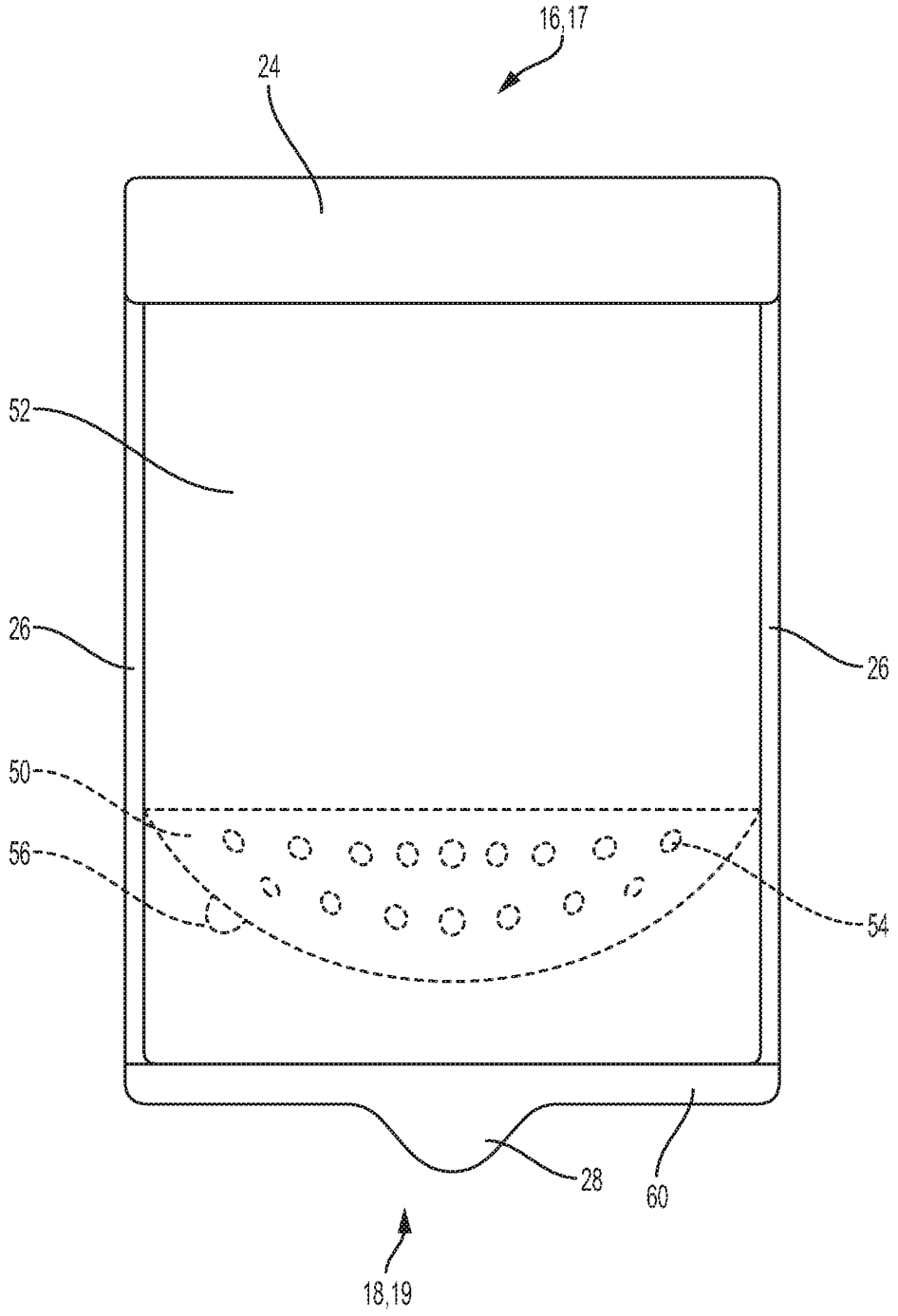
FIG. 3 is a schematic view of a pouch with the collapsible perforated folded panel shown in phantom view according to one or more embodiments of the present disclosure.

With reference to FIGS. 2 and 3, the pouch 1 also includes a collapsible perforated folded panel 50. The collapsible perforated folded panel 50 is attached to the front wall 12 and the rear wall 14 at interior portions of the front wall 12 and the rear wall 14. The attachment of the collapsible perforated folded panel 50 to the front wall 12 and the rear wall 14 defines a pouch chamber 52. The collapsible perforated folded panel 50 is formed from a second flexible film 40. In one or more embodiments, the collapsible perforated folded panel 50 is a gusset in an expandable pouch.

The pouch 1 also has an opening seal 60 disposed between the collapsible perforated folded panel 50 and the second ends 18, 19 of the front wall 12 and the rear wall 14, respectively. The opening seal 60 adheres the second end 18 of the front wall 12 to the second end 19 of the rear wall 14. The opening seal 60 conceals the collapsible perforated folded panel 50. Release or removal of the opening seal 60 is operable to expose the collapsible perforated folded panel 50 by separating the front wall 12 from the rear wall 14 along the second ends 18, 19. Application of a pull force to the second end 18 of the front wall 12 and to the second end 19 of the rear wall 14 is operable to outwardly expand the collapsible perforated folded panel 50 to allow draining of liquid or dispensing of dry powder or flakes from the pouch chamber 52. As will be described below, the opening seal 60 may be removed, for example, by tearing off a portion of the second ends 18, 19, or the opening seal 60 may be released, for example, separated by overcoming the adhesion force between the second ends 18, 19.

The pouch 1 may be configured as a stand-up pouch as illustrated in FIG. 2, for example. When configured as a stand-up pouch, the second ends 18, 19 of the front wall 12 and rear wall 14 support the pouch 1 in an upright orientation upon release of the opening seal 60 and expansion of the collapsible perforated folded panel 50. Orientation in an upright position allows the pouch 1 to be placed in a sink or other receptacle and left to fully drain any liquid therein. Prior to releasing the opening seal 60, the pouch 1 is collapsed into a pillow-pouch as illustrated in FIG. 1, for example.

In one or more embodiments, the pouch 1 comprises opening tabs 28 for application of a pull force to the second end 18 of the front wall 12 and to the second end 19 of the rear wall 14 to outwardly expand the collapsible perforated folded panel 50. Outwardly expanding the collapsible perforated folded panel 50 facilitates draining of liquid from the pouch chamber 52 through the perforations 54. In various embodiments, the opening tabs 28 are portions of the front wall 12 and the rear wall 14 extending beyond the opening seal 60. The opening tabs 28 provide a point which may be grasped for tugging or pulling apart the front wall 12 and the rear wall 14 such that the collapsible perforated folded panel 50 expands and unfolds.

In one or more embodiments, the opening seal 60, the first end seal 24, and the side seals 26 may hermetically seal the pouch chamber 52 from an outside environment.

As stated previously, the collapsible perforated folded panel 50 includes perforations 54 configured to allow drainage of fluid or dispensing of a powder or flaked product from the pouch chamber 52. In one or more embodiments, the perforations 54 are circular or elliptical. In various other embodiments, the perforations 54 are slots, square, rectangular, or combinations of multiple shapes. One skilled in the art will appreciate that the perforations 54 may be formed from various other shapes, for example, perforations shaped substantially like letters to spell a word or product name of the contents of the pouch 1. In one or more embodiments, the perforations 54 are spaced evenly across the collapsible perforated folded panel 50. In further embodiments, the perforations 54 are located in only a portion of the collapsible perforated folded panel 50. Perforations 54 in only a portion of the collapsible perforated folded panel 50 allows the pouch 1 to be slowly drained in a controlled manner or for powder or flaked product to be dispensed from a particular corner or region, for example, near one of the side seals 26. The spacing between perforations 54 may vary depending on the volume of fluid to be drained from the pouch 1, the size of the individual perforations, or other factors. In various embodiments, the collapsible perforated folded panel 50 has 2 to 100 perforations, or 4 to 75 perforations, or 15 to 50 perforations, or 20 to 30 perforations. The total number of perforations 54 may vary depending on the total size of the collapsible perforated folded panel 50, the size of the individual perforations 54, and the desired rate of fluid drainage or dispensing rate of a powder or flaked product.

With reference to FIGS. 2 and 3, in one or more embodiments, the collapsible perforated folded panel 50 has a release member 56 extending outside the pouch chamber. Application of a pull force to the release member 56 is operable to release the collapsible perforated folded panel 50 from at least one of the front wall 12 or the rear wall 14. Releasing the collapsible perforated folded panel 50 from at least one of the front wall 12 or the rear wall 14 allows the solid contents of the pouch chamber 52 to be accessed and removed from the pouch 1. In an embodiment, the release member 56 is a pull tab which, when tugged, pulls the collapsible perforated folded panel 50 away from the front wall 12 and/or the rear wall 14 by breaking the attachment and seal between the collapsible perforated folded panel 50 and the front wall 12 or the rear wall 14. The release member 56 may also be an extra section of the second flexible film 40 extending beyond the point of attachment between the collapsible perforated folded panel 50 and the front wall 12 and/or the rear wall 14. The extra section of the second flexible film 40 provides a point which may be grasped for tugging or tearing away of the collapsible perforated folded panel 50 from the front wall 12 and the rear wall 14.

Figure 4:
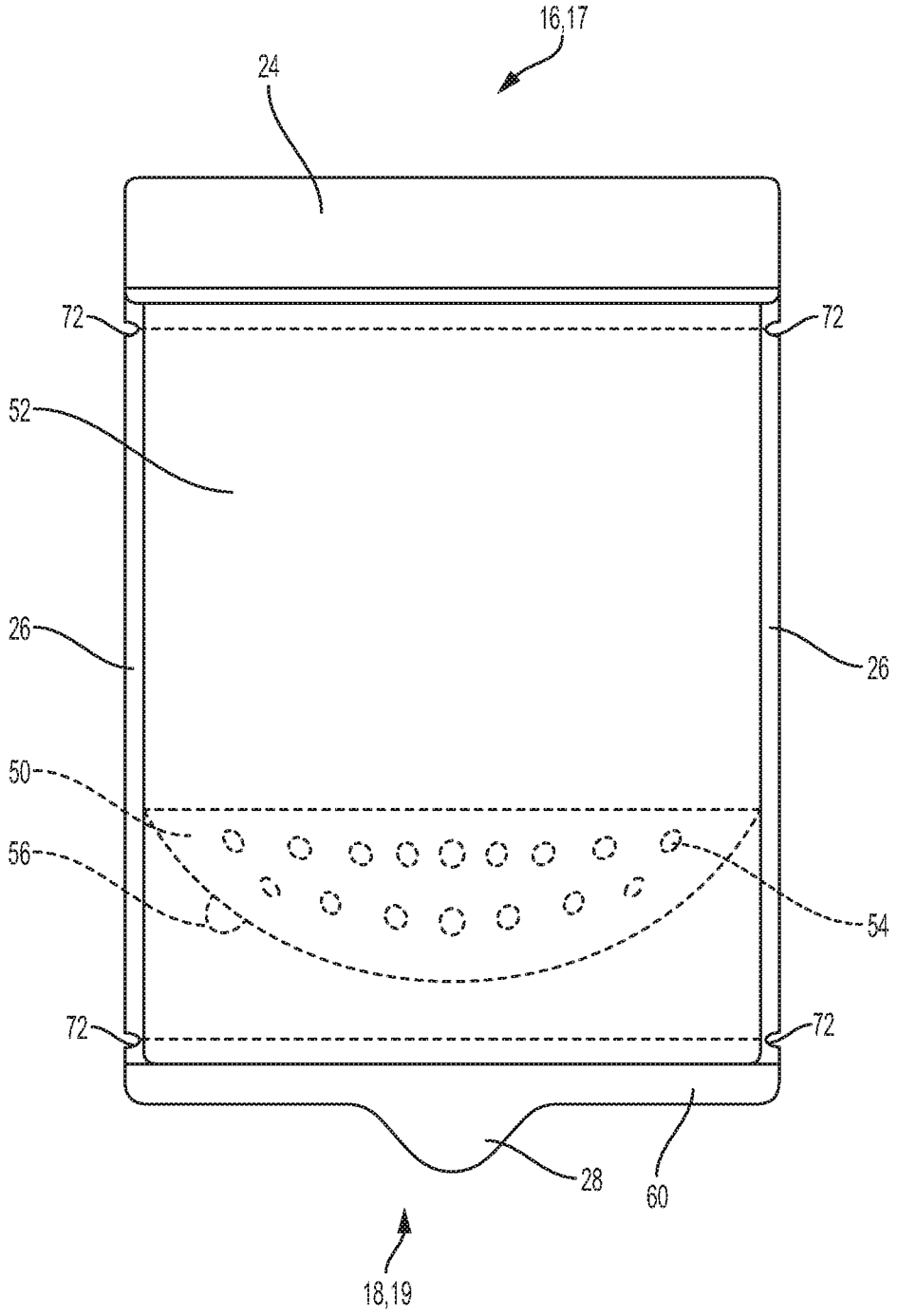
FIG. 4 is a schematic view of a pouch with slits for ease in removal of a portion of the pouch according to one or more embodiments of the present disclosure.

As stated previously, the opening seal 60 may be removed as an alternative to being released. The pouch 1 may include a tearable portion for opening the pouch 1. In one or more embodiments, the opening seal 60 is physically removed from the pouch body 10 by tearing the second ends 18, 19 of the front wall 12 and the rear wall 14 between the opening seal 60 and the collapsible perforated folded panel 50 away from the remainder of the front wall 12 and the rear wall 14 respectively. With reference to FIG. 4, in one embodiment, the positioning of the tearing removal of the opening seal 60 may be achieved by placement of a slit 72 in one or both of the side seals 26 at the desired location(s).

In one or more further embodiments, the first end seal 24 is physically removed from the pouch body 10 by tearing the first ends 16 of the front wall 12 and the rear wall 14 away from the remainder of the front wall 12 and the rear wall 14 respectively. Removal of the first end seal 24 allows the pouch chamber 52 to be accessed without removal of the collapsible perforated folded panel 50. The fluid contents of the pouch 1 may be drained and then the solid contents of the pouch 1 may be accessed through the first end 16, 17 subsequent to removal of the first end seal 24. Similar to removal of the opening seal 60, with reference to FIG. 4, in one embodiment, the positioning of the tearing removal of the first end seal 24 may be achieved by placement of a slit 72 in one or both of the side seals 26 at the desired location(s).

In further embodiments, the pouch 1 may be resealable. In one or more embodiments, the second ends 18, 19 of the front wall 12 and the rear wall 14 may be resealable. Non-limiting examples for resealing the second ends 18 may include utilization of a sealing adhesive in the opening seal 60 which remains sticky and can be resealed, or may include placement of a zipper seal between the collapsible perforated folded panel 50 and the opening seal 60 to reversibly seal the front wall 12 to the rear wall 14. In one or more additional embodiments, the first ends 16, 17 of the front wall 12 and the rear wall 14 may also be resealable. Similarly, non-limiting examples for resealing the first ends 16 may include utilization of a sealing adhesive in the first end seal 24 which remains sticky and can be resealed, or may include the placement of a zipper seal in the pouch chamber 52 proximal the first end seal 24 to reversibly seal the front wall 12 to the rear wall 14.

Figure 5A:
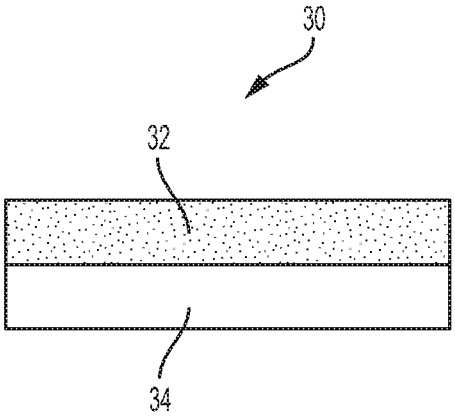
FIG. 5A is a schematic view of a first flexible film according to one or more embodiments of the present disclosure.
Figure 5B:
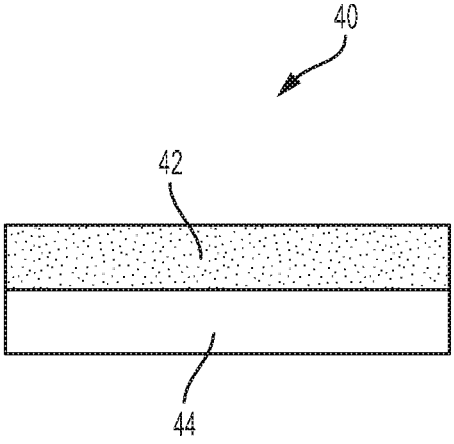
FIG. 5B is a schematic view of a second flexible film according to one or more embodiments of the present disclosure.
Figure 5C:
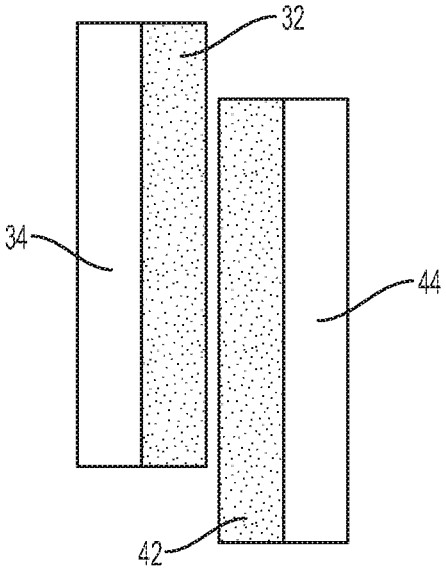
FIG. 5C is a schematic view of a first flexible film and a second flexible film mated together according to one or more embodiments of the present disclosure.

In various embodiments, the first flexible film 30, the second flexible film 40, or both may be monolayer films, multilayer films, or combinations thereof. While the multilayer embodiments described herein focus on two layers, it is contemplated to have many more layers in the first flexible film 30 and/or the second flexible film 40. The multilayer structure of the first flexible film 30 and the second flexible film 40 may each comprise a sealant layer to form a seal with adjoining media and a substrate layer to provide desired structural, environmental, or other material properties. Referring to the embodiments of FIGS. 5A and 5C, the first flexible film 30 has a first sealant layer 32 and a first substrate layer 34. The first substrate layer 34 may be thicker than the first sealant layer 32. In various embodiments, the first substrate layer 34 is 8 times as thick as the first sealant layer 32, 4 times as thick as the first sealant layer 32, or 2 times as thick as the first sealant layer 32. With reference to the embodiments of FIGS. 5B and 5C, the second flexible film 40 has a second sealant layer 42 and a second substrate layer 44. In one or more embodiments, the first flexible film 30 and the second flexible film 40 are the same composition with the sole difference between the pouch body 10 and the collapsible perforated folded panel 50 being the perforations 54 in the collapsible perforated folded panel 50.

In one or more embodiments the second sealant layer 42 and the second substrate layer 44 have different sealing initiation temperatures. The different sealing initiation temperatures allows the second sealant layer 42 or the second substrate layer 44 to form a seal first or exclusively. For example, the second sealant layer 42 may seal with the front wall 12 and the rear wall 14, but the second substrate layer 44 does not seal to another layer or itself at a given sealing temperature and pressure. This arrangement allows a multilayer stack of multilayer films to be heat sealed in a single operation with only the desired layers adhering together. In various embodiments, the temperature delta for the seal initiation temperatures between the second sealant layer 42 or the second substrate layer 44 may be 15° C., 20° C., 30° C., or 40 or more ° C. For example, the second sealant layer 42 may have a seal initiation temperature of 95° C. and the second substrate layer 44 may have a seal initiation temperature of 130° C. Similarly, in one or more embodiments the first sealant layer 32 and the first substrate layer 34 have different sealing initiation temperatures allowing the first sealant layer 32 or the first substrate layer 34 to form a seal first or exclusively.

In one or more embodiments, the pouch body 10 comprises indicia. Non-limiting examples of the indicia include printing to indicate the contents of the pouch 1, instructions for opening the pouch 1, and marketing slogans and graphics.

In yet another embodiment, the opening seal 60 is a peelable seal. Peelable seals are heat sealable and peelable. As used herein, "peelable" generally refers to an ability to separate two materials without compromising the integrity of either of the two. In the case of the pouch 1, this means the front wall 12 may be separated from the rear wall 14 in the region of the opening seal 60 without compromising the integrity of the front wall 12 or rear wall 14.

As a heat sealable seal, a peelable seal is generally formed by applying heat to a multilayer film product, with at least one layer comprising a structural film layer (which may also be called a substrate layer or a backing layer) and a separate layer forming a sealant layer. Application of the heat causes heat to transfer through the structural layer(s) and melt and fuse the sealant layer to form a seal. As such, while the sealant layer is melted to form a seal, the structural layer or layers does not melt. Subsequently, the multilayer film product is cooled to room temperature and the sealant layer solidifies to form the completed seal.

The force required to pull a seal apart is called the seal strength. The adhesion strength can be measured in accordance with ASTM F88-94 (100 mm/min pull speed and clamped 30 mm from seal), for example. In one or more embodiments, the seal strength of the opening seal 60 is less than 25 N/15 mm (9.5 lb/in). In further embodiments, the seal strength of the opening seal 60 is less than 20 N/15 mm (7.6 lb/in). In yet further embodiments, the seal strength of the opening seal 60 is less than 10 N/15 mm (3.8 lb/in). The adhesion strength varies depending on the material of the sealant layer as well as the temperature and pressure applied during seal formation.

In one or more embodiments, the first end seal 24 may be a peelable seal. Similar to the opening seal 60, the seal strength of the first end seal 24 may be less than 25 N/15 mm (9.5 lb/in) when measured in accordance with ASTM F88-94 (100 mm/min pull speed and clamped 30 mm from seal), or less than 20 N/15 mm (7.6 lb/in), or less than 10 N/15 mm (3.8 lb/in).

Moreover, the attachment of the collapsible perforated folded panel 50 to the front wall 12 and the rear wall 14 is with a peelable seal. In one or more embodiments, the seal strength of the attachment of the collapsible perforated folded panel 50 to the front wall 12 and the rear wall 14 is less than 10 N/15 mm (3.8 lb/in) when measured in accordance with ASTM F88-94 (100 mm/min pull speed and clamped 30 mm from seal), or less than 8 N/15 mm (3.0 lb/in), or less than 4 N/15 mm (1.5 lb/in).

The adhesion strength may be adjusted by adjusting the temperature, pressure, or dwell time of a fusing nip configured to form the seals in the desired locations. For example, increasing the pressure applied by the fusing nip during a sealing operation generally results in a seal with an increased adhesion strength. Similarly, increasing the temperature of the fusing nip also generally results in an increased adhesion strength until such an elevated temperature is reached that the integrity of the film structure is damaged. For example, a peelable seal may be expected to form with a fusing nip pressure of 3 bars and a temperature in the range of 100 to 130° C. for a ½ second dwell time, whereas a lock-up (or non-peelable) seal may be expected to form with a fusing nip pressure of 5 bars and a temperature in excess of 150° C. for a ½ second dwell time. The particular materials and structure of the films determine the specific seal strength profile for varying temperatures and/or pressures. Besides temperature and pressure, the sealing bar geometry may influence seal strength. A flat sealing bar, in general, tends to promote peelability. Conversely, a serrated or non-flat sealing bar tends to promote a lock-up or non-peelable seal. It should be appreciated that each parameter may be varied in conjunction or separately to promote the desired sealing behavior and seal strength. For example low temperature, low pressure, and flat sealing bars will produce differing seal characteristics than high temperature, high pressure, and serrated sealing bars, which will both produce differing seal characteristics than very high temperature, low pressure, and flat bars.

The sealant layer of peelable seals is generally made from one or more polymeric resins. The resulting characteristics of the peelable film and the sealant layer depend largely upon the type of the resins used to form the multilayer film. U.S. Pat. No. 7,863,383, incorporated by reference herein in its entirety, discloses a variety of heat sealable and peelable seals. It is contemplated that other peelable seals may be utilized in forming a peelable seal for the opening seal 60, the first end seal 24, or both.

While the first sealant layer 32 and the second sealant layer 42 form the peelable seals, the first substrate layer 34 and the second substrate layer 44 may provide other desirable characteristics to the first flexible film 30 and the second flexible film 40 respectively. The first substrate layer 34 and the second substrate layer 44 may provide tearing or stretching strength, oxygen barrier properties, opacity, or other desirable material properties to the first flexible film 30 and second flexible film 40.

In one or more embodiments, the first flexible film 30, the second flexible film 40 or both may comprise polyolefins, polystyrenes, or combinations thereof. These polyolefins may include, but are not limited to, polyolefin plastics, polyolefin elastomers, polyolefin plastomers, or combinations thereof. In one or more embodiments, the first sealant layer 32, the second sealant layer 42, or both may comprise a blend of a propylene based plastomer or elastomer, and at least one of a polyethylene or a polystyrene based polymer. In further embodiments, the first sealant layer 32, the second sealant layer 42, or both may comprise ethylene vinyl acetate (EVA) and ethylene methyl acrylate (EMA) copolymers, polybutylene mixed with an EVA polymer, polyolefins (including plastomers) mixed with an EVA polymer, and ionomers, such as SURLYN® (E. I. du Pont de Nemours and Company), mixed with EVA. Suitable commercial products for use in the first sealant layer 32 and/or the second sealant layer 42 may include the SEALUTION™ product line of peel polymers from The Dow Chemical Company (Midland, Mich.). These SEALUTION™ products may include but are not limited to SEALUTION™140, SEALUTION™220, or SEALUTION™230.

The first substrate layer 34 and/or the second substrate layer 44 may include polyolefins, polyolefins, such as high-density polyethylene (HDPE), polyethylene (PE), polypropylene (PP), polyethylene terephthalate (PET), polyamides (PA), aluminum foils, or combinations thereof. In one or more embodiments, the polymers may be biaxially oriented (i.e., stretched) and may include, for example, biaxially oriented polyethylene terephthalate (BOPET), or biaxially oriented polypropylene (BOPP), biaxially oriented polyamide (BOPA), or other materials used in flexible packaging.

It should be understood that the first flexible film 30 and the second flexible film 40 may contain various additives. Examples of such additives include antioxidants, ultraviolet light stabilizers, thermal stabilizers, slip agents, antiblock pigments or colorants, processing aids (such as fluoropolymers), crosslinking catalyst, flame retardants, fillers, foaming agents, and combinations thereof.

It is further noted that terms like "preferably," "generally," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present disclosure.

It will be apparent that modifications and variations are possible without departing from the scope of the disclosure defined in the appended claims. More specifically, although some aspects of the present disclosure are identified herein as preferred or particularly advantageous, it is contemplated that the present disclosure is not necessarily limited to these aspects.

The invention claimed is:

1. A pouch comprising:

a pouch body formed from a first flexible film and comprising a front wall and a rear wall, the front wall and the rear wall each comprising a first end, a second end, and side edges connecting the first end and the second end, wherein the rear wall is adhered to the front wall at corresponding first ends to form a first end seal and corresponding side edges to form side seals;

a collapsible perforated folded panel formed from a second flexible film and attached to the front wall and the rear wall at interior portions of the front wall and the rear wall, respectively, with peelable seals formed directly between the collapsible perforated folded panel and the front wall and the rear wall such that the attachment of the collapsible perforated folded panel to the front wall and the rear wall define a pouch chamber; and an opening seal disposed between the collapsible perforated folded panel and the second ends of the front wall and the rear wall, wherein the opening seal adheres the second end of the front wall to the second end of the rear wall which thereby conceals the collapsible perforated folded panel, wherein release or removal of the opening seal is operable to expose the collapsible perforated folded panel by separating the front wall from the rear wall along the second ends and application of a pull force to the second end of the front wall and to the second end of the rear wall is operable to outwardly expand the collapsible perforated folded panel to allow draining of liquid or dispensing of dry powder or flakes from the pouch chamber, wherein the collapsible perforated folded panel comprises a release member extending outside the pouch chamber, wherein application of a pull force to the release member is operable to break the peelable seal between the collapsible perforated folded panel and the front wall or the rear wall.

2. The pouch of claim 1, wherein the first flexible film, the second flexible film, or both are multilayer films.

3. The pouch of claim 2, wherein the first flexible film comprises a first sealant layer and a first substrate layer.

4. The pouch of claim 2, wherein the second flexible film comprises a second sealant layer and a second substrate layer.

5. The pouch of claim 2, wherein the opening seal, the first end seal, and the side seals hermetically seal the pouch chamber.

6. The pouch of claim 2, wherein the release member extending outside the pouch chamber is an extra section of the second flexible film extending beyond the point of attachment between the collapsible perforated folded panel and the front wall, the collapsible perforated folded panel and the rear wall, or the collapsible perforated folded panel and both the rear wall and the front wall.

7. The pouch of claim 2, wherein the second ends comprise opening tabs for application of a pull force to the second end of the front wall and to the second end of the rear wall to outwardly expand the collapsible perforated folded panel.

8. The pouch of claim 1, wherein the first flexible film comprises a first sealant layer and a first substrate layer.

9. The pouch of claim 1, wherein the second flexible film comprises a second sealant layer and a second substrate layer.

10. The pouch of claim 9, wherein the second sealant layer and the second substrate layer have different sealing initiation temperatures.

11. The pouch of claim 1, wherein the first flexible film and the second flexible film are the same composition.

12. The pouch of claim 1, wherein the opening seal, the first end seal, and the side seals hermetically seal the pouch chamber.

13. The pouch of claim 1, wherein the release member extending outside the pouch chamber is an extra section of the second flexible film extending beyond the point of attachment between the collapsible perforated folded panel and the front wall, the collapsible perforated folded panel and the rear wall, or the collapsible perforated folded panel and both the rear wall and the front wall.

14. The pouch of claim 1, wherein the release member extending outside the pouch chamber is a release tab.

15. The pouch of claim 1, wherein the opening seal has a seal strength of less than 10 N/15 mm when measured according to ASTM F88-94 at a pull speed of 100 mm/minute.

16. The pouch of claim 1, wherein the second ends comprise opening tabs for application of a pull force to the second end of the front wall and to the second end of the rear wall to outwardly expand the collapsible perforated folded panel.

17. The pouch of claim 1, wherein the first flexible film comprises polyethylene terephthalate (PET), biaxially oriented polyethylene terephthalate (BOPET), or biaxially oriented polypropylene (BOPP), polyamide (PA), or an aluminum foil.

18. The pouch of claim 1, wherein the second flexible film comprises polyolefins.

19. The pouch of claim 1, wherein the first end seal has a seal strength of less than 10 N/15 mm when measured according to ASTM F88-94 at a pull speed of 100 mm/minute.

20. The pouch of claim 1, wherein the opening seal, the first end seal, the side seals, or both comprises a propylene based plastomer or elastomer and at least one of a polyethylene or a polystyrene based polymer.

* * * * *